US011493046B2

(12) United States Patent
Matsui et al.

(10) Patent No.: US 11,493,046 B2
(45) Date of Patent: Nov. 8, 2022

(54) SCROLL COMPRESSOR

(71) Applicant: Mitsubishi Electric Corporation, Tokyo (JP)

(72) Inventors: Tomokazu Matsui, Tokyo (JP); Yuji Takamura, Tokyo (JP); Yutaro Iwamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/299,589

(22) PCT Filed: Feb. 14, 2019

(86) PCT No.: PCT/JP2019/005223
§ 371 (c)(1),
(2) Date: Jun. 3, 2021

(87) PCT Pub. No.: WO2020/165985
PCT Pub. Date: Aug. 20, 2020

(65) Prior Publication Data

US 2022/0018348 A1 Jan. 20, 2022

(51) Int. Cl.

| | |
|---|---|
| ***F04B 39/06*** | (2006.01) |
| ***F25B 31/00*** | (2006.01) |
| ***F04C 18/02*** | (2006.01) |
| ***F25B 47/00*** | (2006.01) |
| ***F04C 15/00*** | (2006.01) |
| ***F04C 28/28*** | (2006.01) |

(Continued)

(52) U.S. Cl.
CPC ..... *F04C 29/04* (2013.01); *F04C 18/0215* (2013.01); *F04C 28/28* (2013.01); *F04C 2240/30* (2013.01); *F04C 2240/81* (2013.01)

(58) Field of Classification Search
CPC ..... F04C 29/04; F04C 29/0028; F04C 28/28; F04C 15/0046; F04C 18/0215; F25B 47/006; F25B 31/006
See application file for complete search history.

(56) References Cited

U.S. PATENT DOCUMENTS 10,495,360 B2 * 12/2019 Takayama ..... F04B 39/0061
2002/0139137 A1 * 10/2002 Tipton ..... F25B 47/006 165/63

(Continued)

FOREIGN PATENT DOCUMENTS

CN 107614878 A 1/2018
JP S59-203893 A 11/1984

(Continued)

OTHER PUBLICATIONS

English translation of WO2008/056594 by Espacenet, Apr. 7, 2022.*

(Continued)

*Primary Examiner* — Deming Wan
(74) *Attorney, Agent, or Firm* — Posz Law Group, PLC

(57) ABSTRACT

A scroll compressor includes a shell that is cylindrical, a fixed scroll fixed to an inner wall of the shell, an orbiting scroll that faces the fixed scroll, a frame fixed to the inner wall of the shell and that supports the orbiting scroll, and a heat source device provided on an outside of the shell and between the fixed scroll and the frame and configured to heat or cool the shell from the outside.

12 Claims, 6 Drawing Sheets

(51) Int. Cl.
*F04C 29/04* (2006.01)
*F04C 29/00* (2006.01)

(56) References Cited

U.S. PATENT DOCUMENTS

| | | | | |
|---|---|---|---|---|
| 2014/0308138 | A1* | 10/2014 | Pham | F04B 49/02 417/63 |
| 2018/0128270 | A1 | 5/2018 | Koyama et al. | |
| 2020/0025200 | A1 | 1/2020 | Takai et al. | |

FOREIGN PATENT DOCUMENTS

| | | | | |
|---|---|---|---|---|
| JP | S63-038684 | U | 3/1988 | |
| JP | H04-318298 | A | 11/1992 | |
| JP | 2008-056594 | * | 11/2007 | F04C 18/0215 |
| JP | 2018-035723 | A | 3/2018 | |
| WO | 2018/078787 | A1 | 5/2018 | |

OTHER PUBLICATIONS

International Search Report of the International Searching Authority dated May 21, 2019 for the corresponding International application No. PCT/JP2019/005223 (and English translation).
Office Action dated Jul. 29, 2022 issued in corresponding CN Patent Application No. 201980091376.9 (and English translation).

* cited by examiner

SCROLL COMPRESSOR

CROSS REFERENCE TO RELATED APPLICATION

This application is a U.S. national stage application of PCT/JP2019/005223 filed on Feb. 14, 2019, the contents of which are incorporated herein by reference.

TECHNICAL FIELD

The present disclosure relates to a scroll compressor intended for apparatuses such as air-conditioning apparatuses and refrigerating apparatuses.

BACKGROUND ART

In a known scroll compressor, a frame that supports a fixed scroll is fixed to the inner wall of a shell that is cylindrical. The frame extends in the axial direction of the shell and includes a cylindrical outer wall surrounding a scroll lap of the fixed scroll. The frame is fixed to the inner wall of the shell at the outer peripheral surface of the outer wall of the frame by a method such as shrink fitting. An axial end face of the outer wall of the frame and a base plate of the fixed scroll that are in contact with each other are fixed to each other with screws. Thus, the fixed scroll is fixed to the outer wall of the frame. In such a configuration, as the outer wall of the frame is positioned surrounding the scroll lap of the fixed scroll, only a narrow refrigerant suction space is provided. In view of widening the refrigerant suction space, some scroll compressors proposed in recent years each include a frame including no outer wall (see Patent Literature 1, for example). According to Patent Literature 1, as the frame includes no outer wall, the fixed scroll has to be fixed to nowhere and is therefore directly fixed to the inner wall of the shell.

CITATION LIST

Patent Literature

Patent Literature 1: International Publication No. 2018/078787

SUMMARY OF INVENTION

Technical Problem

In a scroll compressor including a frame with an outer-wall-less structure in which a fixed scroll is fixed to the inner wall of a shell as disclosed by Patent Literature 1, the pressure and heat generated during operations cause the fixed scroll and an orbiting scroll to bend and thermally expand. Consequently, the lap tip of each of the scrolls, which faces with each other, comes into contact with or interferes with the lap bottom of the other scroll. Such a situation may eventually lead to seizing at the tips of the scroll laps.

To prevent the above problem, a satisfactory lap-tip clearance needs to be provided between the tip of each of the scroll laps and the lap bottom of the other scroll at the time of assembly. However, as the lap-tip clearance may be a passage that allows refrigerant gas to leak, setting a wide lap-tip clearance causes another problem of efficiency reduction due to the leakage of refrigerant gas through the lap-tip clearance.

Hence, it is important that the lap-tip clearance at the time of assembly is set to an optimum possible lap-tip clearance with which the leakage of refrigerant gas is reduced while the occurrence of lap-tip contact during operations is prevented. Instead of setting the lap-tip clearance at the time of assembly to an optimum possible value, the lap-tip clearance during operations may be adjusted by adjusting the temperature of the shell to cause the shell to expand or contract. In Patent Literature 1, however, no discussion is made about the idea of adjusting the lap-tip clearance during operations.

The present disclosure is to solve the above problem and provides a scroll compressor including a frame with an outer-wall-less structure and in which the lap-tip clearance during operations is adjustable.

Solution to Problem

A scroll compressor according to an embodiment of the present disclosure includes a shell that is cylindrical, a fixed scroll fixed to an inner wall of the shell, an orbiting scroll that faces the fixed scroll, a frame fixed to the inner wall of the shell and that supports the orbiting scroll, and a heat source device provided on an outside of the shell and between the fixed scroll and the frame and configured to heat or cool the shell from the outside.

Advantageous Effects of Invention

According to an embodiment of the present disclosure, as the scroll compressor includes the heat source device configured to heat or cool the shell from the outside, the lap-tip clearance during operations is adjusted.

DESCRIPTION OF EMBODIMENTS

Figure 1:
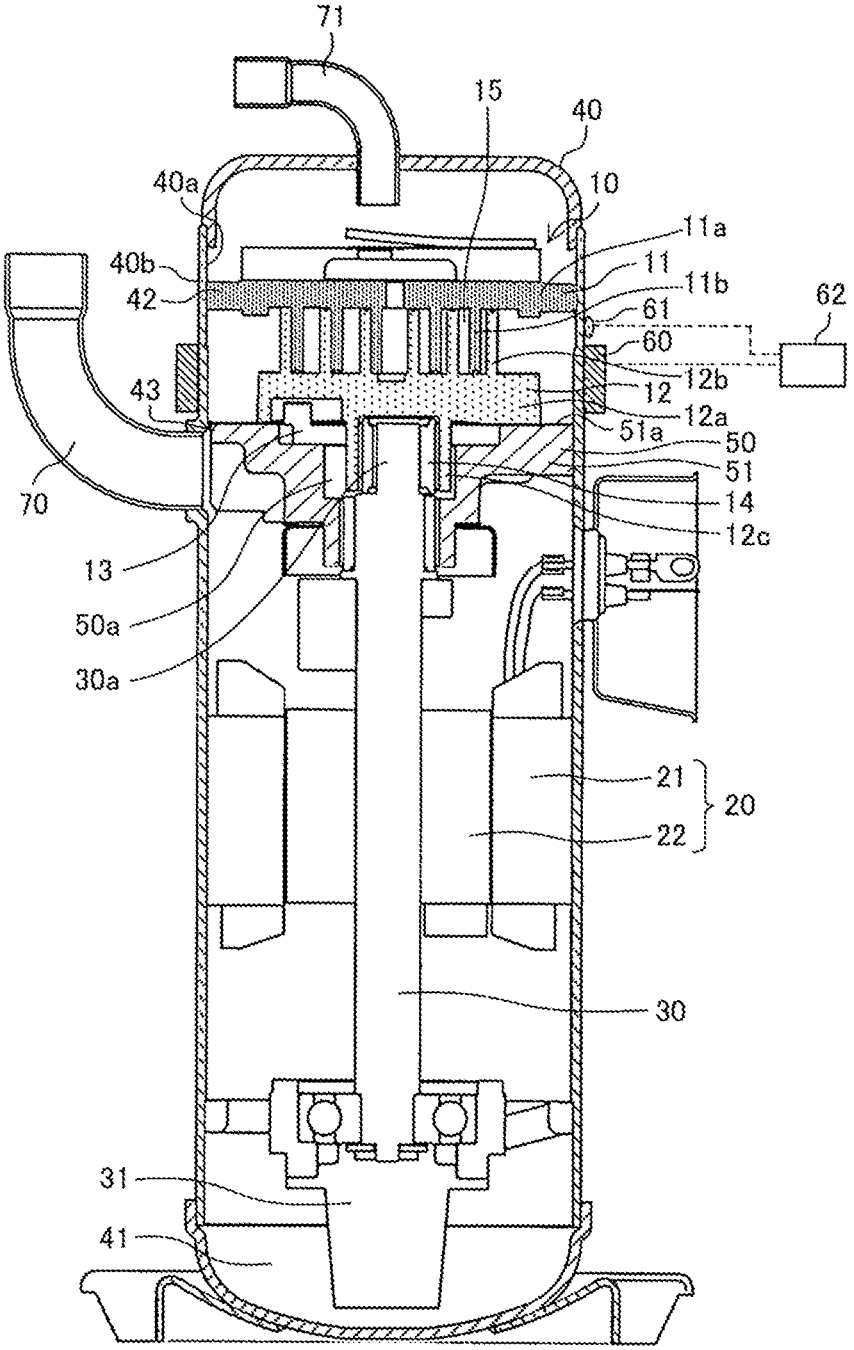
FIG. 1 is a schematic diagram illustrating an internal configuration of a scroll compressor according to Embodiment 1 of the present disclosure.

FIG. 1 is a schematic diagram illustrating an internal configuration of a scroll compressor according to Embodiment 1 of the present disclosure.

The scroll compressor includes a compressing mechanism unit 10, a driving mechanism unit 20 that drives the compressing mechanism unit 10, and a main shaft 30 that transmits a driving force of the driving mechanism unit 20 to the compressing mechanism unit 10. The compressing mechanism unit 10, the driving mechanism unit 20, and the main shaft 30 are housed in a shell 40, which is a cylindrical hermetic container forming an outer shell of the scroll compressor. The shell 40 further houses a frame 50. The frame 50 is fixed to the inner peripheral surface of the shell 40 by a method such as shrink fitting. The frame 50 in the shell 40 is positioned between the compressing mechanism unit 10 and the driving mechanism unit 20. The frame 50 supports the main shaft 30 in a through-hole provided in the center of the frame 50 such that the main shaft 30 is allowed to rotate. The frame 50 further supports an orbiting scroll 12 to be described below such that the orbiting scroll 12 is allowed to rotate.

A bottom portion of the shell 40 is used as an oil reservoir 41 where refrigerating machine oil is stored. The refrigerating machine oil in the oil reservoir 41 is pumped up by a pump 31 provided at the lower end of the main shaft 30, flows through an oil-feeding hole (not illustrated) extending through the main shaft 30 in the axial direction, and is fed to an oil sump 50*a* provided in the frame 50 and to relevant slide portions.

The shell 40 is provided with a suction pipe 70 through which refrigerant gas on the outside is suctioned into the shell 40, and a discharge pipe 71 through which compressed refrigerant gas is discharged to the outside of the shell 40.

The compressing mechanism unit 10 is configured to compress the refrigerant gas when driven by the driving mechanism unit 20. The refrigerant gas is a fluid to be compressed and is suctioned through the suction pipe 70. The compressing mechanism unit 10 includes a fixed scroll 11, and the orbiting scroll 12, which faces the fixed scroll 11.

The fixed scroll 11 includes a base plate 11*a*, and a scroll lap 11*b* formed as a swirling projection standing on one face of the base plate 11*a*. The fixed scroll 11 is fixed to the inner peripheral surface of the shell 40 at the outer peripheral surface of the base plate 11*a* of the fixed scroll 11 by a method such as shrink fitting.

The orbiting scroll 12 includes a base plate 12*a*, and a scroll lap 12*b* formed as a swirling projection standing on one face of the base plate 12*a*. The orbiting scroll 12 has a cylindrical orbital boss portion 12*c* on the other face (hereinafter referred to as the back face) of the base plate 12*a*. An eccentric shaft portion 30*a*, to be described below, provided at the upper end of the main shaft 30 is fitted in the orbital boss portion 12*c*.

The orbiting scroll 12, which is prevented from rotating on its own axis by an Oldham ring 13, orbits the fixed scroll 11. The Oldham ring 13 is fitted in both a groove provided in the back face of the base plate 12*a* of the orbiting scroll 12 and a groove provided in the frame 50. The Oldham ring 13 prevents the orbiting scroll 12 from rotating on its own axis and allows the orbiting scroll 12 to perform only the orbital motion.

The fixed scroll 11 and the orbiting scroll 12 are fitted to each other and attached to the shell 40 such that the scroll lap 11*b* of the fixed scroll 11 and the scroll lap 12*b* of the orbiting scroll 12 are in mesh with each other. The scroll lap 11*b* and the scroll lap 12*b* provide, between scroll lap 11*b* and the scroll lap 12*b*, a plurality of compression chambers 15 whose capacities change relative to one another.

The driving mechanism unit 20 is configured to drive the orbiting scroll 12 to compress the refrigerant gas in the compressing mechanism unit 10. Specifically, when the driving mechanism unit 20 drives the orbiting scroll 12 through the main shaft 30, the compressing mechanism unit 10 compresses the refrigerant gas. The driving mechanism unit 20 includes a stator 21 and a rotor 22. The rotor 22 is fixed to the main shaft 30 by a method such as press fitting. When the stator 21 is energized, the rotor 22 is driven to rotate and thus rotates the main shaft 30.

The main shaft 30 includes the eccentric shaft portion 30*a* at the upper end of the main shaft 30. The eccentric shaft portion 30*a* is fitted, with a slider 14 in between, to an orbital bearing (not illustrated) provided in the orbital boss portion 12*c* of the orbiting scroll 12. Thus, power is transmitted to the orbiting scroll 12.

The frame 50 has a shape in which a plurality of cylindrical portions are arranged in series in the axial direction of the shell 40. The cylindrical portions have different diameters that decrease toward the driving mechanism unit 20. The frame 50 has an outer-wall-less structure. A cylindrical portion 51, which is one of the plurality of cylindrical portions that is closest to the fixed scroll 11, is fixed at the outer peripheral surface of the cylindrical portion 51 to the inner peripheral surface of the shell 40 by a method such as shrink fitting. The frame 50 supports the main shaft 30 in the through-hole provided in the center of the frame 50 such that the main shaft 30 is allowed to rotate. The frame 50 further supports the orbiting scroll 12 by an annular flat surface 51*a* of the frame 50 such that the orbiting scroll 12 is allowed to rotate. The flat surface 51*a* is a face of the cylindrical portion 51 that faces toward the fixed scroll 11.

What is characteristic in Embodiment 1 is employing a heat source device 60, which heats or cools the shell 40 from the outside. Specifically, the heat source device 60 may include a heating unit such as a heater, and a cooling unit such as a cooler, or may include another device such as a Peltier device capable of both heating and cooling. The heat source device 60 is driven by an external power source.

The heat source device 60 is provided on the outside of the shell 40 and between the fixed scroll 11 and the frame 50. More specifically, the heat source device 60 is provided between a fixing position 42 at which the shell 40 and the fixed scroll 11 are fixed to each other and a fixing position 43 at which the shell 40 and the frame 50 are fixed to each other. The heat source device 60 is in contact with an outer wall 40*b* of the shell 40. A temperature sensor 61 that measures the surface temperature of a shell peripheral face as the temperature of the outer wall 40*b* is provided on the outer wall 40*b* of the shell 40. The temperature measured by the temperature sensor 61 is input to a controller 62 to be described below.

The heat source device 60 is controlled by the controller 62 with reference to the temperature measured by the temperature sensor 61. The controller 62 includes devices such as a CPU that executes a program stored in dedicated hardware or a dedicated memory. How to control the heat source device 60 by the controller 62 will be described separately below.

How the heat source device 60 changes lap-tip clearances during operations will be described below. Herein, the clearance between the scroll lap of one of the fixed scroll 11 and the orbiting scroll 12 and the base plate of the other scroll is defined as lap-tip clearance.

Figure 2:
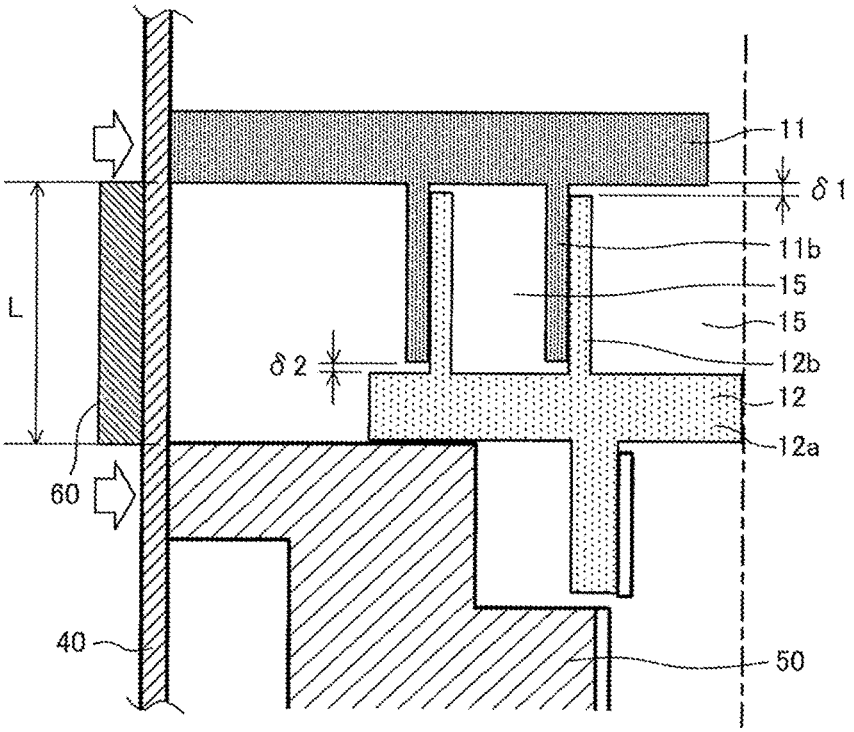
FIG. 2 is a schematic enlargement of relevant part of a compressing mechanism unit included in the scroll compressor according to Embodiment 1 of the present disclosure.

FIG. 2 is a schematic enlargement of relevant part of the compressing mechanism unit included in the scroll compressor according to Embodiment 1 of the present disclosure.

A lap-tip clearance δ1 of the fixed scroll 11 and a lap-tip clearance δ2 of the orbiting scroll 12 at the time of assembly are specified in advance. Hereinafter, the lap-tip clearance δ1 and the lap-tip clearance δ2 at the time of assembly are referred to as specified values. A method of determining the specified values will be described separately below.

A distance L between the lower end of the fixing position 42 at which the fixed scroll 11 and the shell 40 are fixed to each other and the upper end of the fixing position 43 at which the frame 50 and the shell 40 are fixed to each other changes when the shell 40 is heated or cooled by the heat source device 60. Specifically, when the shell 40 is heated by the heat source device 60, the surface temperature of the shell peripheral face rises. Accordingly, the shell 40 expands in the axial direction, increasing the distance L. Thus, the lap-tip clearances are increased. When the shell 40 is cooled by the heat source device 60, the surface temperature of the shell peripheral face drops. Accordingly, the shell 40 contracts in the axial direction, reducing the distance L. Thus, the lap-tip clearances are reduced.

As the distance L is changeable by heating or cooling the shell 40 with the heat source device 60 as described above, the lap-tip clearances are forcibly adjustable. As described above, the heat source device 60 is provided between the fixing position 42 at which the fixed scroll 11 and the shell 40 are fixed to each other and the fixing position 43 at which the frame 50 and the shell 40 are fixed to each other, that is, at a position where a noticeable effect is obtained in changing the distance L. Therefore, the shell 40 can be efficiently made to expand or contract with the heat generated by the heat source device 60.

How the scroll compressor operates will be described below.

When power is supplied from the external power source to the stator 21, the rotor 22 rotates. A turning force thus generated is transmitted through the main shaft 30 to the orbiting scroll 12. The orbiting scroll 12 is prevented from rotating on its own axis by the Oldham ring 13 and therefore starts to perform an orbital motion. The compression chambers 15 provided between the fixed scroll 11 and the orbiting scroll 12 continuously receive the refrigerant suctioned into the shell 40 through the suction pipe 70. In each of the compression chambers 15, a series of processes of suction, compression, and discharge of the refrigerant are repeated. The lubricating oil stored at the bottom of the shell 40 is brought up with the rotation of the main shaft 30, lubricates relevant bearings, and is then returned to the oil reservoir 41 at the bottom of the shell 40.

In the compression process, the refrigerant gas is subjected to a pressure increase accompanied by a temperature rise. Therefore, to the fixed scroll 11 and the orbiting scroll 12 that define the compression chambers 15, the pressure of the compressed gas is applied. Simultaneously, the fixed scroll 11 and the orbiting scroll 12 thermally expand with the heat transmitted from the compressed gas.

How the lap-tip clearances change with the effect of pressure and thermal expansion during operations will be described below.

(Bending Due to Pressure)

Figure 3:
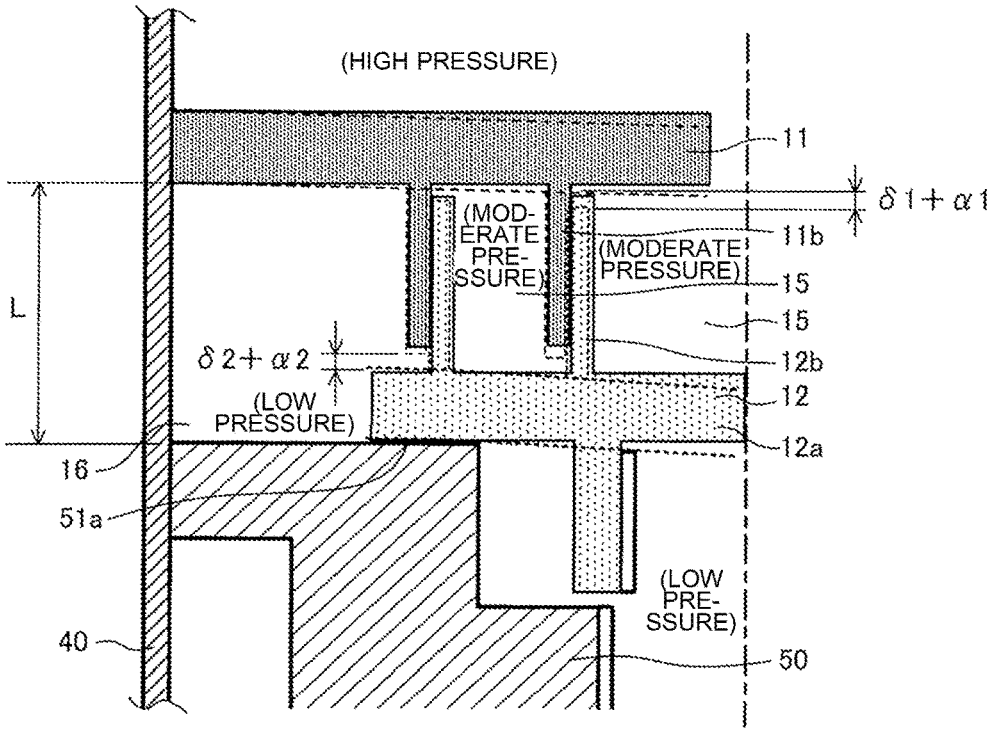
FIG. 3 is a diagram of the compressing mechanism unit illustrated in FIG. 2 and illustrates how lap-tip clearances change with pressure.

FIG. 3 is a diagram of the compressing mechanism unit illustrated in FIG. 2 and illustrates how the lap-tip clearances change with pressure. In FIG. 3, dotted lines represent the positions of the scrolls bent by the pressure. Note that the heat source device 60 is not illustrated in FIG. 3 and in FIG. 4 to be referred to below.

During operations, as illustrated in FIG. 3, the fixed scroll 11 is subjected to a high pressure as discharge pressure at a back face of the fixed scroll 11. During operations, the compression chambers 15 are each subjected to a moderate pressure, which is lower than the discharge pressure and is still increasing. Meanwhile, a refrigerant suction space 16 in the compression chambers 15, which is close to the outer periphery of the scroll compressor, is subjected to a low pressure as suction pressure, which is lower than the moderate pressure.

The relationship among the pressures applied to the fixed scroll 11 is as above. Therefore, the fixed scroll 11, which is fixed to an inner wall 40*a* of the shell 40 at the outer periphery of the base plate 11*a*, bends in a direction in which the scroll lap 11*b* extends from the fixed scroll 11 as represented by the dotted lines in FIG. 3.

On the other hand, during operations, the orbiting scroll 12 is subjected to a low pressure as suction pressure at the back face of the orbiting scroll 12. During operations, the compression chambers 15 are each subjected to a moderate pressure, as described above. Meanwhile, the refrigerant suction space 16 in the compression chambers 15, which is close to the outer periphery of the scroll compressor, is subjected to a low pressure, as described above.

The relationship among the pressures applied to the orbiting scroll 12 is as above. Therefore, the orbiting scroll 12, which is supported by the flat surface 51*a* of the frame 50 at the outer periphery of the back face and its vicinity of the base plate 12*a*, bends in a direction in which the back face of the base plate 12*a* faces as represented by the dotted lines in FIG. 3.

As the orbiting scroll 12 and the fixed scroll 11 each bend as described above, the lap-tip clearances change from $\delta 1$ and $\delta 2$ to $\delta 1+\alpha 1$ and $\delta 2+\alpha 2$, respectively.

(Thermal Expansion Due to Temperature Rise)

Figure 4:
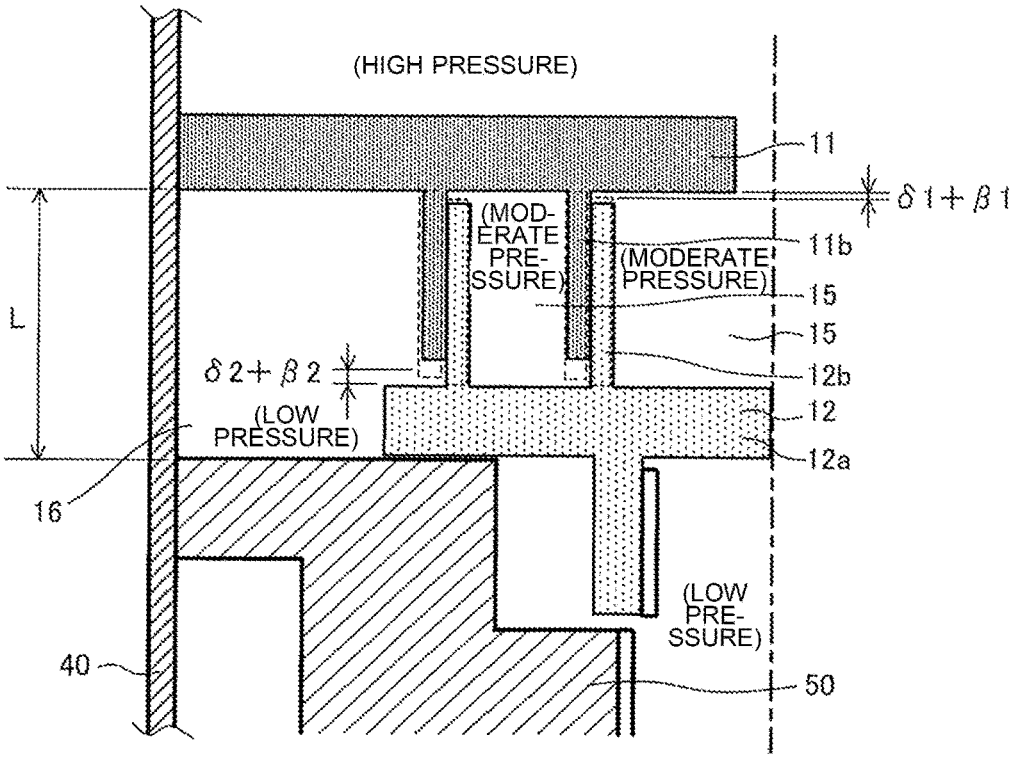
FIG. 4 is a diagram of the compressing mechanism unit illustrated in FIG. 2 and illustrates how the lap-tip clearances change with a temperature rise.

FIG. 4 is a diagram of the compressing mechanism unit illustrated in FIG. 2 and illustrates how the lap-tip clearances change with a temperature rise.

When the temperature in the compression chambers 15 rises with the effects of the temperatures of the suctioned gas and the discharged gas, the orbiting scroll 12 and the fixed scroll 11 thermally expand. With such thermal expansion, the heights of the scroll lap 12*b* and the scroll lap 11*b* each increase as represented by dotted lines in FIG. 4. Accordingly, the lap-tip clearances are reduced from $\delta 1$ and $\delta 2$ to $\delta 1+\beta 1$ and $\delta 2+\beta 2$, respectively. Note that 131 and 132 are negative values.

The bending due to pressure and the thermal expansion due to temperature rise described above change the lap-tip clearances of the orbiting scroll 12 and the fixed scroll 11 during operations from $\delta 1$ and $\delta 2$ to $\delta 1+\alpha 1+\beta 1$ and $\delta 2+\alpha 2+\beta 2$, respectively. Thus, the suction pressure and discharge pressure and the suction temperature and discharge temperature during operations significantly change the lap-tip clearances from the respective values $\delta 1$ and $\delta 2$ specified for the time of assembly.

In the known art, in consideration of the above changes in the lap-tip clearances during operations, the lap-tip clearances at the time of assembly are specified such that lap-tip contact, which is caused by the elimination of the lap-tip clearances, does not occur during operations within a predetermined operating range. In Embodiment 1, unlike the case of the known art, as the lap-tip clearances are adjustable by using the heat source device 60, the specified values at the time of assembly can be set smaller than the values specified in the known art. The lap-tip clearances may be passages that allow leakage between the compression chambers 15. Therefore, the performance of the compressor is improved by setting the specified values as small as possible.

(Operation of Heat Source Device)

The heat source device 60 is controlled by the controller 62 such that the surface temperature of the shell peripheral face that is measured by the temperature sensor 61 is within a target temperature range corresponding to current operating conditions. The operating conditions are set for suction pressure and discharge pressure. The lap-tip clearances increase when the surface temperature of the shell peripheral face rises, and decrease when the surface temperature of the shell peripheral face drops. In consideration of such a correlation between the surface temperature of the shell peripheral face and the lap-tip clearances, the lap-tip clearances are maintained to be optimum possible by controlling the heat source device 60 such that the surface temperature of the shell peripheral face is within the target temperature range.

Herein, the optimum possible lap-tip clearances refer to clearances with which the leakage of refrigerant gas is reduced while the occurrence of lap-tip contact during operations is prevented so that a high efficiency is maintained. Compressors have respective operating ranges that are set in accordance with specifications of the compressors. The target temperature range is set with reference to data obtained through monitoring performed in advance for checking how the lap-tip clearances change within the operating range. A method of setting the target temperature range, including a method of determining the specified values for the lap-tip clearances, will be described below.

First, a method of determining the specified values for the lap-tip clearances will be described with reference to FIGS. 5 and 6.

Figure 5:
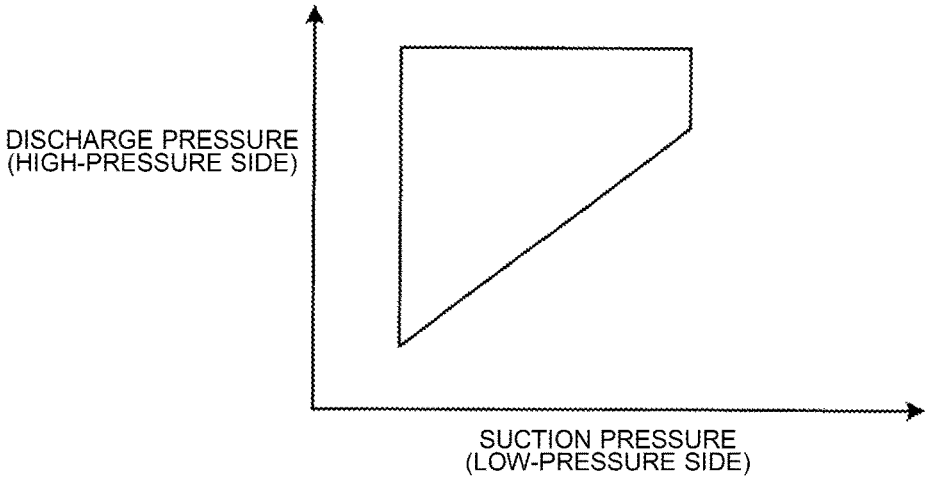
FIG. 5 is a diagram illustrating an operating range.

FIG. 5 is a diagram illustrating an operating range.

In FIG. 5, a zone enclosed by straight lines represents an operating range that is set in accordance with specifications of a scroll compressor. The operating range is determined by suction pressure and discharge pressure. Discharge pressure involves a temperature factor.

Herein, the specified values for the lap-tip clearances are set smaller than "the clearances with which lap-tip contact does not occur during operations within the operating range". A result of monitoring of a scroll compressor that is set as above and is operated within the operating range illustrated in FIG. 5 is illustrated in FIG. 6. Specifically, with reference to monitoring data at specific operating points (i.e., specific sets of operating conditions) within the operating range illustrated in FIG. 5, the relationship between the surface temperature of the shell peripheral face and the efficiency of the scroll compressor is graphed in FIG. 6.

Figure 6:
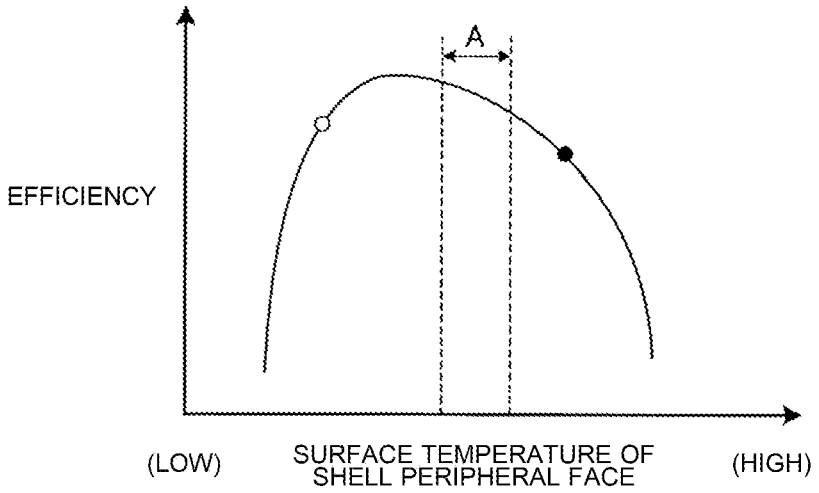
FIG. 6 is a graph illustrating the relationship between the surface temperature of a shell peripheral face and efficiency.

FIG. 6 is the graph illustrating the relationship between the surface temperature of the shell peripheral face and the efficiency. In FIG. 6, the horizontal axis represents the surface temperature of the shell peripheral face, and the vertical axis represents the operation efficiency of the scroll compressor (hereinafter referred to as the efficiency).

The relationship between the surface temperature of the shell peripheral face and the efficiency is shown by a graph that is convex upward. A high efficiency means that the lap-tip clearances are small and the refrigerant leakage in the compression process is little. The graph shows a tendency that the efficiency drops significantly in a range of the surface temperature of the shell peripheral face that is below a certain point. Such a tendency is caused by lap-tip contact. That is, in an operation in which, as plotted by a white dot, the surface temperature of the shell peripheral face is below a point corresponding to the peak of the efficiency, lap-tip contact may be caused. On the other hand, in an operation in which, as plotted by a black dot, the surface temperature of the shell peripheral face is above the point corresponding to the peak of the efficiency, the lap-tip clearances may be extremely large, resulting in an operation with low efficiency.

To summarize, when the surface temperature of the shell peripheral face is within a range A where the efficiency is a little lower than the highest point, the occurrence of lap-tip contact is avoided and an efficient operation is achieved within the operating range. In consideration of such a monitoring result, the range A is set as the target temperature range. That is, the target temperature range is set to a temperature range within which the occurrence of lap-tip contact during operations is avoided and an efficiency higher than or equal to a set value is obtained.

The graph illustrated in FIG. 6 is made for each of different sets of operating conditions. That is, the controller 62 holds different target temperature ranges that are set in advance for different sets of operating conditions, and the controller 62 controls the heat source device 60 with reference to one of the target temperature ranges that corresponds to the current operating conditions.

Figure 7:
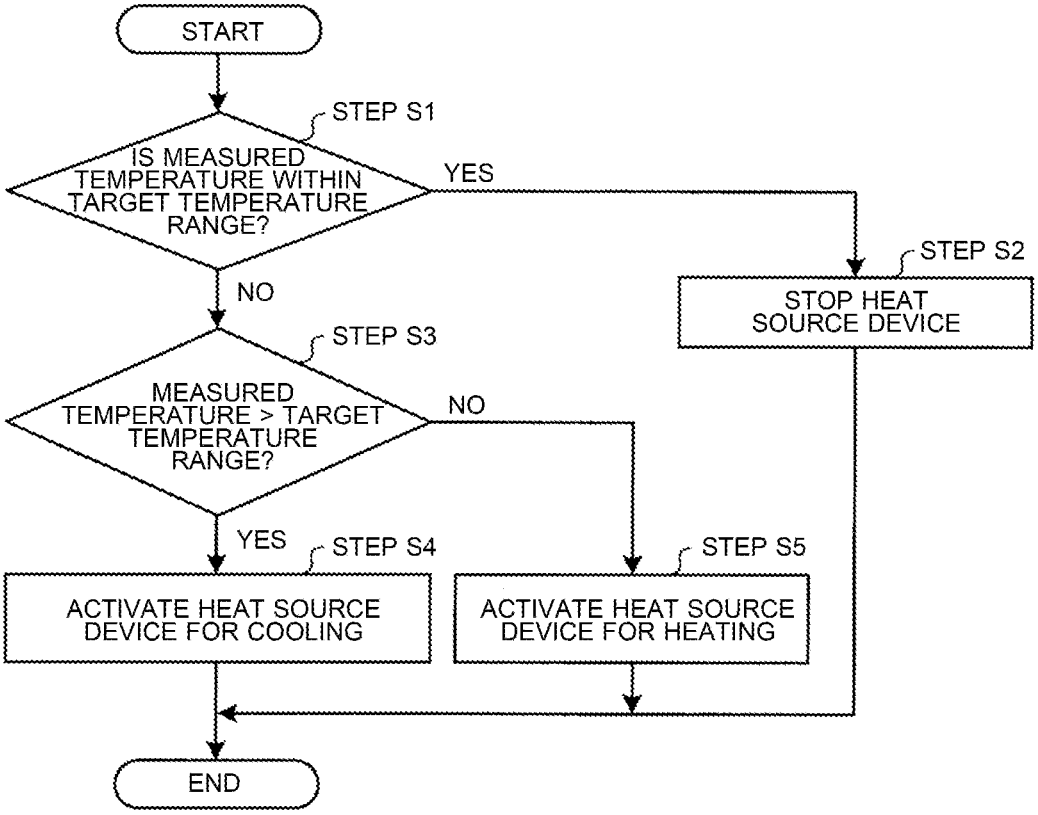
FIG. 7 is a flow chart illustrating a control procedure performed by a controller of the scroll compressor according to Embodiment 1 of the present disclosure.

FIG. 7 is a flow chart illustrating a control procedure performed by the controller of the scroll compressor according to Embodiment 1 of the present disclosure. The control procedure illustrated as the flow chart in FIG. 7 is performed at every control interval.

After an operation of the scroll compressor is started, the controller 62 checks whether the temperature measured by the temperature sensor 61 is within the target temperature range corresponding to the current operating conditions (step S1). When the temperature measured by the temperature sensor 61 is within the target temperature range, the controller 62 stops the heat source device 60 (step S2). When the temperature measured by the temperature sensor 61 is above the target temperature range (YES in step S3), the controller 62 activates the heat source device 60 for cooling (step S4) to make the shell 40 contract. Thus, the lap-tip clearances are reduced, and thus the efficiency is increased. When the temperature measured by the temperature sensor 61 is below the target temperature range (NO in step S3), the controller 62 activates the heat source device 60 for heating (step S5) to make the shell 40 expand. Thus, the lap-tip clearances are increased, and thus the occurrence of lap-tip contact is prevented.

According to Embodiment 1, as described above, the heat source device 60, which heats or cools the shell 40 from the outside, is provided on the outside of the shell 40 and between the fixed scroll 11 and the frame 50 in the axial direction of the shell 40. Therefore, a portion of the shell 40 that is between the fixed scroll 11 and the frame 50 in the axial direction of the shell 40 is heated or cooled and is thus made to expand or contract by changing the temperature of the portion of the shell. In other words, the distance L between the fixed scroll 11 and the frame 50 in the axial direction of the shell 40, which is a factor for determining the lap-tip clearances, is flexibly changeable. Hence, the lap-tip clearances during operations are forcibly changeable.

According to Embodiment 1, the lap-tip clearances are changeable. Therefore, even when the lap-tip clearances that are set for the time of assembly are not large enough, the occurrence of lap-tip contact is avoided. Consequently, the occurrence of failures of the compressor is prevented. Specifically, in an operation where there is any chance of lap-tip contact, the shell 40 is heated by using the heat source device 60 so that the lap-tip clearances are increased.

According to Embodiment 1, the heat source device 60 is provided in contact with the outer wall 40*b* of the shell 40. Therefore, the heat generated by the heat source device 60 is transmitted efficiently to the outer wall 40*b* of the shell 40.

According to Embodiment 1, the controller 62 controls the heat source device 60 such that the temperature of the shell peripheral face is within the target temperature range. Therefore, the scroll compressor is operated with the lap-tip clearances maintained to be optimum possible, increasing the performance of the scroll compressor. Specifically, the controller 62 controls the heat source device 60 as follows. When the measured temperature is above the target temperature range, the shell 40 is cooled by the heat source device 60. When the measured temperature is below the target temperature range, the shell 40 is heated by the heat source device 60. Thus, the shell 40 is made to expand or contract, and thus the lap-tip clearances are adjusted to be optimum possible.

The controller 62 controls the heat source device 60 with reference to the target temperature range corresponding to the operating conditions set for the scroll compressor. Therefore, the lap-tip clearances are adjusted more appropriately than in a case where the target temperature range is fixed regardless of the operating conditions.

While the compressor is stopped and is at a low temperature, a phenomenon of refrigerant stagnation, in which refrigerant gathers in the shell 40, may occur. In case of such refrigerant stagnation, the liquid refrigerant in the compressing mechanism unit 10 is evaporated easily by heating the shell 40 with the heat source device 60. Therefore, the time period of stagnation can be shortened. Consequently, the occurrence of activation failure is avoided.

Even when the scroll compressor operates irregularly above or below the predetermined operating range, the occurrence of failures of the compressor due to lap-tip contact is prevented by temporarily changing the lap-tip clearances with the heat source device 60.

In Embodiment 1, the heat source device 60 has been described as a device capable of performing both heating and cooling. The heat source device 60 only needs to be capable of performing at least one of heating and cooling. When the heat source device 60 is a heating-only device, the lap-tip clearances at the time of assembly may be set smaller than the clearances with which lap-tip contact does not occur during operations. In such a manner, when lap-tip contact is likely to occur, the heat source device 60 may be activated to increase the lap-tip clearances. When the heat source device 60 is a cooling-only device, the lap-tip clearances at the time of assembly may be set large, in consideration of safe design that does not cause lap-tip contact. In such a manner, when an operation that tends to increase the lap-tip clearances is performed, the heat source device 60 may be activated to reduce the lap-tip clearances.

Figure 8:
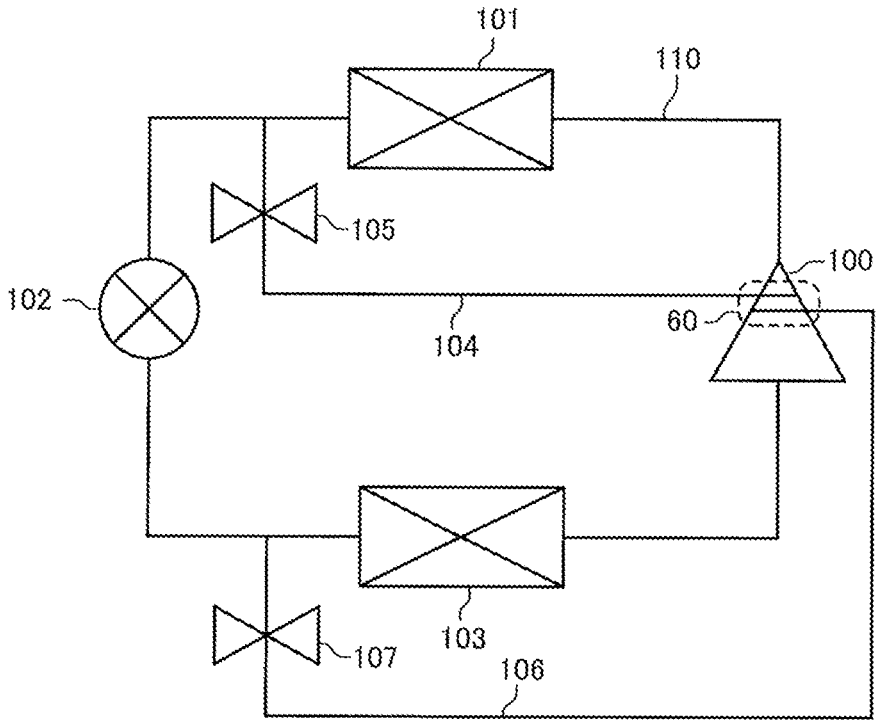
FIG. 8 is a diagram illustrating a modification of a heat source device included in the scroll compressor according to Embodiment 1 of the present disclosure.

While the heat source device 60 has been described as a device that performs heating or cooling by using a device such as a cooler or a heater, the heat source device 60 may perform heating or cooling by using refrigerant that circulates through a refrigerant circuit as illustrated in FIG. 8.

FIG. 8 is a diagram illustrating a modification of the heat source device included in the scroll compressor according to Embodiment 1 of the present disclosure.

FIG. 8 illustrates a refrigeration cycle apparatus including a scroll compressor 100 according to Embodiment 1. The heat source device 60 according to the present modification heats or cools the shell 40 by using refrigerant that circulates through a refrigerant circuit 110 included in the refrigeration cycle apparatus.

The refrigeration cycle apparatus includes the refrigerant circuit 110, which causes the refrigerant to circulate through the scroll compressor 100, a condenser 101, an expansion valve 102, and an evaporator 103. The refrigeration cycle apparatus further includes a heating circuit 104 and an on-off valve 105. The heating circuit 104 extends from a point between the condenser 101 and the expansion valve 102 to the shell peripheral face of the scroll compressor 100 and thus heats the shell 40. The on-off valve 105 opens or closes the heating circuit 104. The refrigeration cycle apparatus further includes a cooling circuit 106 and an on-off valve 107. The cooling circuit 106 extends from a point between the expansion valve 102 and the evaporator 103 to the shell peripheral face of the scroll compressor 100 and thus cools the shell 40. The on-off valve 107 opens or closes the cooling circuit 106. The heat source device 60 includes a part of the heating circuit 104 and a part of the cooling circuit 106.

The refrigerant is compressed by the scroll compressor 100 into high-temperature and high-pressure gas refrigerant. The high-temperature and high-pressure gas refrigerant flows into the condenser 101. In the condenser 101, the refrigerant performs phase change from high-temperature and high-pressure gas to liquid. Then, the refrigerant is decompressed and expanded by the expansion valve 102 into low-temperature and low-pressure two-phase refrigerant and flows into the evaporator 103. In the evaporator 103, the refrigerant performs phase change from liquid to gas. The refrigerant discharged from the evaporator 103 is suctioned into the scroll compressor 100.

The flow of the refrigerant in the refrigerant circuit 110 is as above. The high-temperature refrigerant flowing from the condenser 101 toward the expansion valve 102 thus passes through the heating circuit 104. Therefore, when the on-off valve 105 is opened, the shell 40 is heated by the refrigerant passing through the heating circuit 104. Meanwhile, the refrigerant decompressed by the expansion valve 102 to have a low temperature passes through the cooling circuit 106. Therefore, when the on-off valve 107 is opened, the shell 40 is cooled by the refrigerant passing through the cooling circuit 106.

Thus, the heat source device 60 may be configured as a device that performs cooling or heating by using refrigerant flowing through the refrigerant circuit 110.

REFERENCE SIGNS LIST

10: compressing mechanism unit, 11: fixed scroll, 11*a*: base plate, 11*b*: scroll lap, 12: orbiting scroll, 12*a*: base plate, 12*b*: scroll lap, 12*c*: orbital boss portion, 13: Oldham ring, 14: slider, 15: compression chamber, 16: refrigerant suction space, 20: driving mechanism unit, 21: stator, 22: rotor, 30: main shaft, 30*a*: eccentric shaft portion, 31: pump, 40: shell, 40*a*: inner wall, 40*b*: outer wall, 41: oil reservoir, 42: fixing position, 43: fixing position, 50: frame, 50*a*: oil sump, 51: cylindrical portion, 51*a*: flat surface, 52: rotor, 60: heat source device, 61: temperature sensor, 62: controller, 70: suction pipe, 71: discharge pipe, 100: scroll compressor, 101: condenser, 102: expansion valve, 103: evaporator, 104: heating circuit, 105: on-off valve, 106: cooling circuit, 107: on-off valve, 110: refrigerant circuit

The invention claimed is:

1. A scroll compressor comprising:

a shell that is cylindrical;

a fixed scroll fixed to an inner wall of the shell;

an orbiting scroll that faces the fixed scroll;

a frame fixed to the inner wall of the shell and that supports the orbiting scroll;

a heater provided on an outside of the shell and between the fixed scroll and the frame and configured to heat the shell from the outside; and a cooler provided on the outside of the shell and between the fixed scroll and the frame and configured to cool the shell from the outside.

2. The scroll compressor of claim 1, wherein the cheater and the cooler are provided in contact with an outer wall of the shell.

3. The scroll compressor of claim 1, wherein the heater is configured to perform heating by using refrigerant flowing in a refrigerant circuit, or the cooler is configured to perform cooling by using refrigerant flowing in the refrigerant circuit.

4. The scroll compressor of claim 1, further comprising:

a temperature sensor configured to measure a temperature of an outer wall of the shell; and a controller configured to control the heater and the cooler, wherein the controller is configured to control the heater and the cooler such that a measured temperature obtained by the temperature sensor is within a target temperature range.

5. The scroll compressor of claim 4, wherein the controller is configured to cause the cooler to cool the shell when the measured temperature is above the target temperature range and to cause the heater to heat the shell when the measured temperature is below the target temperature range.

6. The scroll compressor of claim 4, wherein the controller is configured to control the heater and the cooler with reference to the target temperature range, the target temperature range corresponding to operating conditions set for the scroll compressor.

7. The scroll compressor of claim 4, wherein the fixed scroll and the orbiting scroll each include a base plate and a scroll lap, a clearance between the scroll lap of one of the fixed scroll and the orbiting scroll and the base plate of an other one of the fixed scroll and the orbiting scroll is defined as a lap-tip clearance, and the target temperature range is set to a temperature range within which occurrence of lap-tip contact caused by elimination of the lap-tip clearance during operation is avoided and an operation efficiency higher than or equal to a set value is achieved.

8. A scroll compressor comprising:

a shell that is cylindrical;

a fixed scroll fixed to an inner wall of the shell;

an orbiting scroll that faces the fixed scroll;

a frame fixed to the inner wall of the shell and that supports the orbiting scroll;

a heater provided on an outside of the shell and between the fixed scroll and the frame and configured to heat the shell from the outside;

a cooler provided on the outside of the shell and between the fixed scroll and the frame and configured to cool the shell from the outside;

a temperature sensor configured to measure a temperature of an outer wall of the shell; and a controller configured to control the heater and the cooler, wherein the controller is configured to control the heater and the cooler such that a measured temperature obtained by the temperature sensor is within a target temperature range, the fixed scroll and the orbiting scroll each include a base plate and a scroll lap, a clearance between the scroll lap of one of the fixed scroll and the orbiting scroll and the base plate of an other one of the fixed scroll and the orbiting scroll is defined as a lap-tip clearance, and the target temperature range is set to a temperature range within which occurrence of lap-tip contact caused by elimination of the lap-tip clearance during operation is avoided and an operation efficiency higher than or equal to a set value is achieved.

9. The scroll compressor of claim 8, wherein the heater and the cooler are provided in contact with an outer wall of the shell.

10. The scroll compressor of claim 8, wherein the heater is configured to perform heating by using refrigerant flowing in a refrigerant circuit, or the cooler is configured to perform cooling by using refrigerant flowing in the refrigerant circuit.

11. The scroll compressor of claim 8, wherein the controller is configured to cause the cooler to cool the shell when the measured temperature is above the target temperature range and to cause the heater to heat the shell when the measured temperature is below the target temperature range.

12. The scroll compressor of claim 8, wherein the controller is configured to control the heater and the cooler with reference to the target temperature range, the target temperature range corresponding to operating conditions set for the scroll compressor.

* * * * *